US006584634B2

(12) United States Patent
Stiefenhofer

(10) Patent No.: US 6,584,634 B2
(45) Date of Patent: Jul. 1, 2003

(54) HYDROPNEUMATIC WASHING DEVICE

(76) Inventor: Carly Flury Stiefenhofer, Carrera 64A No. 75A-37, Medellin (CO), No 75A-37

( * ) Notice: Subject to any disclaimer, the term of this patent is extended or adjusted under 35 U.S.C. 154(b) by 62 days.

(21) Appl. No.: 09/865,524

(22) Filed: May 29, 2001

(65) Prior Publication Data

US 2002/0020028 A1 Feb. 21, 2002

(30) Foreign Application Priority Data

Aug. 18, 2000 (CO) ..... 00-62165

(51) Int. Cl.[7] ..... D06F 5/02
(52) U.S. Cl. ..... 8/159; 68/216
(58) Field of Search ..... 8/159; 68/216, 68/217, 215, 122

(56) References Cited

U.S. PATENT DOCUMENTS

| | | | | |
|---|---|---|---|---|
| 1,846,664 A | * | 2/1932 | Wilsey | 68/122 |
| 2,025,654 A | * | 12/1935 | Eberhard | 68/217 |

FOREIGN PATENT DOCUMENTS

| | | | | |
|---|---|---|---|---|
| AU | 165321 | * | 9/1955 | 68/216 |
| DE | 544518 | * | 2/1932 | 68/216 |
| DE | 817291 | * | 10/1951 | 68/216 |
| FR | 714801 | * | 11/1931 | 68/216 |
| GB | 696705 | * | 9/1953 | 68/216 |
| SE | 155748 | * | 7/1932 | 68/216 |

* cited by examiner

*Primary Examiner*—Philip R. Coe
(74) *Attorney, Agent, or Firm*—Pennie & Edmonds LLP

(57) ABSTRACT

A manually operated washing device which functions by a hydropneumatic principle involving compression of a volume of air and water trapped in the interior of the device. The device includes an inner and an outer housing which are slidable relative to one another, the inner housing being positioned at least partially within the interior of the outer housing. A spring is positioned inside the outer housing between an upper end of the inner housing and an upper end of the outer housing. The spring is compressible so that the outer housing is slidable over the inner housing. A pressurized jet is created through compression and expansion and the pressurized jet is expelled through a perforated portion of the device against a mass of submerged clothing in order to effect washing of the clothing.

17 Claims, 3 Drawing Sheets

HYDROPNEUMATIC WASHING DEVICE

FIELD OF THE INVENTION

This invention relates to a washing device, such as a device for washing clothing. More particularly, the invention relates to a manual hydropneumatic washing device which expels jets of water and air. The invention also relates to a method of washing utilizing a device according to the invention.

BACKGROUND OF THE INVENTION

In the area of technology of the design and manufacture of household electrical appliances, particularly clothes washing machines, numerous forms of devices have been developed that include sophisticated means of programming task modes, such as washing, rinsing, and wringing of the clothing, and subsequent drying of the clothing. Currently available products are often highly elaborate. The associated high costs of design and production are passed on to consumers in commensurately higher sales prices.

The present invention differs in its principle of operation from the electro-mechanical devices employed by customary washing machines. Instead, the invention provides a novel, manually operated device which operates by compression. The device can be entirely manually powered so that compression is generated, according to one class of embodiments, solely by the manual thrust force applied to the device. In one embodiment of the invention, where the device is entirely manual, hydropneumatic energy is generated in the interior of the device via pumping of the device. This energy is converted into pressurized jets of water and air, which are ejected through orifices or nozzles in the device. Preferably, the jets of water and air are ejected against clothing in a washing tub or other apparatus. When detergent is used, efficacious and economical washing is provided without incurring the expense of electrical energy.

SUMMARY OF THE INVENTION

The present invention relates to a washing device and a method for performing washing. The washing device has hydropneumatic action involving compression of a volume of air and water, with the air and water being expelled from the washing device under pressure. The washing device includes an outer housing, an inner housing, and a spring. The outer housing has an upper and a lower end and defines an interior. The outer housing has an upper surface substantially covering the upper end thereof and an opening in the lower end thereof. The inner housing is positioned at least partially in the interior of the outer housing and has a passageway extending longitudinally therethrough. An upper end of the inner housing is positioned inside the interior of the outer housing and the lower end of the inner housing extends through the opening in the lower end of the outer housing. The inner and outer housings are slidable relative to one another. The spring is positioned in the interior of the outer housing between the upper end of the inner housing and the upper surface of the outer housing. The spring is substantially resilient.

The outer housing may be substantially cylindrical and the upper surface of the outer housing may be dome shaped. The inner housing may also be substantially cylindrical and the passageway through the inner housing may be substantially cylindrical. The dome shaped upper surface of the outer housing may be generally convex.

In one embodiment of the device, the outer housing includes a shoulder positioned at the lower end thereof. The shoulder extends inwardly from an outer wall of the outer housing and defines, at an inner edge of the shoulder, the opening in the lower end of the outer housing. The shoulder provides sliding contact against the inner housing. The inner housing includes a projecting flange portion positioned at the upper end thereof, with the flange portion being positioned in the interior of the outer housing for sliding contact with an interior wall of the outer housing.

The shoulder may include a plurality of orifices distributed therethrough, wherein jets of liquid and compressed air in the interior of the outer housing are expelled through the orifices under pressure. The shoulder may be annular and the orifices circular. The orifices may also be spaced around the shoulder in a generally regular pattern. Alternatively, the shoulder may include a lip at an inner edge thereof, with the lip being positioned adjacent the inner edge of the shoulder at the opening of the outer housing.

An upper surface of the flange portion may include a projection for association with the spring. The projection may be a ridge and the spring may be retained by the ridge. The upper surface of the outer housing may include a downward projection for association with an upper end of the spring and the upper end of the spring may be retained against the projection.

The projection on the upper surface of the outer housing may be internally threaded and generally cylindrical. Furthermore, the inner housing may include a bracing portion positioned at the lower end of the inner housing within the passageway thereof.

The washing device may also include a projection extending from the upper surface of the outer housing and a thrust source attached to the projection on the upper surface for applying a thrust to the outer housing. The thrust source may be a pressurized fluid source, such as compressed air or water.

The method of performing washing according to the invention includes providing an outer housing with an upper surface substantially covering the upper end of the outer housing, an opening provided at the lower end of the outer housing, and an interior. The method also includes providing an inner housing having an upper end and a lower end, with a passageway extending through the interior of the inner housing from the upper end to the lower end. The upper end of the inner housing is positioned inside the interior of the outer housing and the lower end of the inner housing extends outside the outer housing through the opening in the lower end of the outer housing. The method further includes providing a spring in the interior of the outer housing positioned between the upper end of the inner housing and the upper surface of the outer housing. The spring is resilient. The method also includes providing a plurality of orifices along the lower end of the outer housing to allow fluid to exit the interior of the outer housing and positioning the device in a source of air and water. The method also includes sliding the outer housing relative to the inner housing against a force of the spring to suction up water into the interior of the outer housing and expel a jet of water and air through the orifices provided along the lower end of the outer housing to perform washing.

The method may also include providing a projection extending from an upper surface of the outer housing, attaching a thrust source to projection extending from the upper surface, and applying a thrust to the outer housing via the thrust source.

BRIEF DESCRIPTION OF THE DRAWINGS

Preferred features of the present invention are disclosed in the accompanying drawings, wherein identical reference characters denote like elements throughout the several views, which illustrate an exemplary embodiment, and wherein.

DETAILED DESCRIPTION OF THE INVENTIONS

Figure 1:
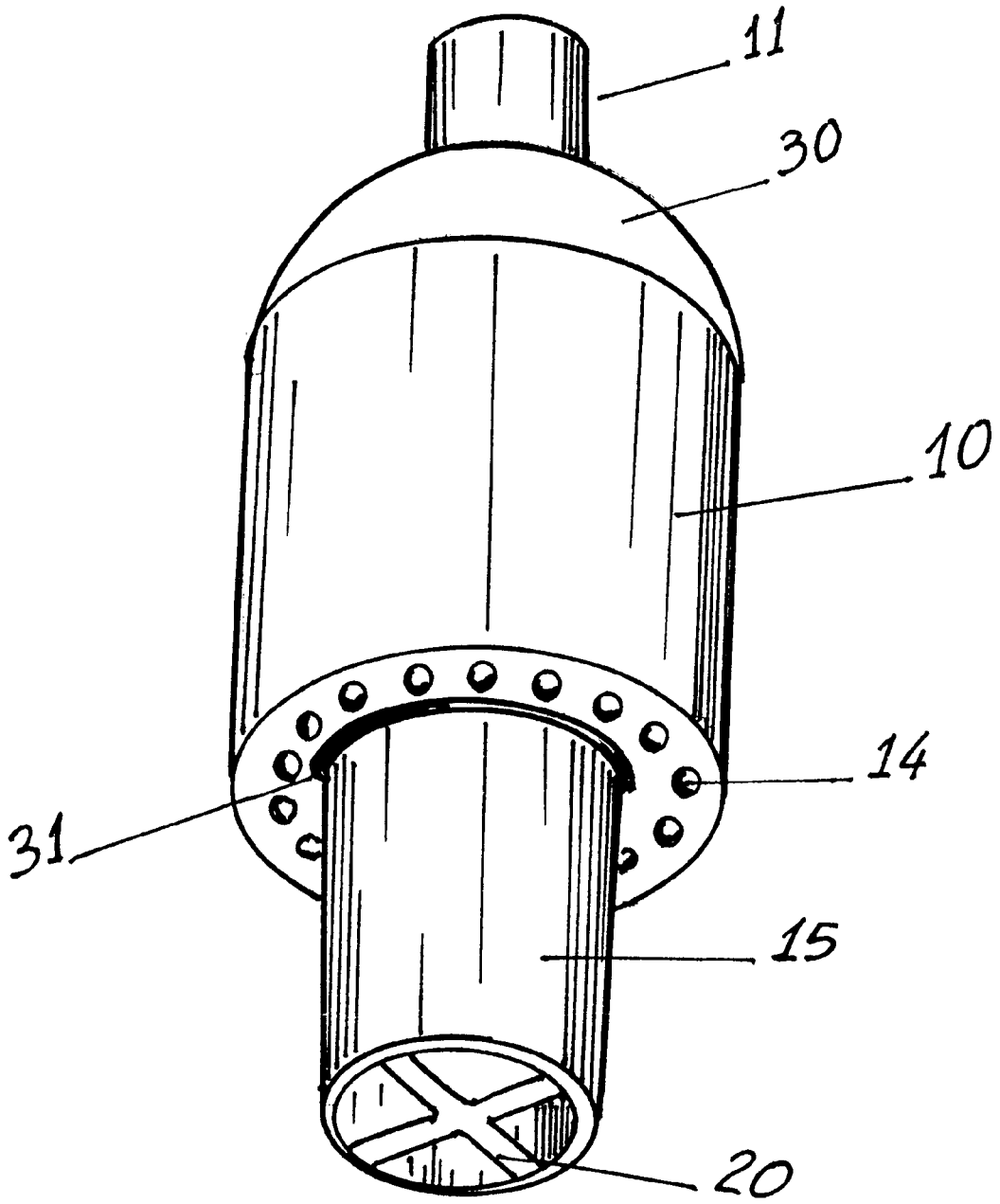
FIG. 1 is an overall perspective view of the hydropneumatic washing device according to the invention as viewed from its lower end.

Referring to FIG. 1, the washing device according to the invention includes several coupled elements, including a first body or outer housing 10 and a second body or inner housing 15. First body 10 is a covering portion that, as shown, is generally cylindrical and includes a roof portion or upper surface 30 at its top end, and an opening 31 at its lower end. The roof portion 30 may preferably be dome-shaped, and may have a generally convex shape, as shown in FIG. 1. A cylindrical projection 11 extends from the roof portion 30. Projection is preferably positioned centrally on the roof portion 30 and axially aligned with the longitudinal axis of the first body 10. The cylindrical projection 11 preferably includes an interior thread 12, as shown in FIG. 2, which is useful in mating with an outside thrust source, such as compressed air, among other sources.

Figure 2:
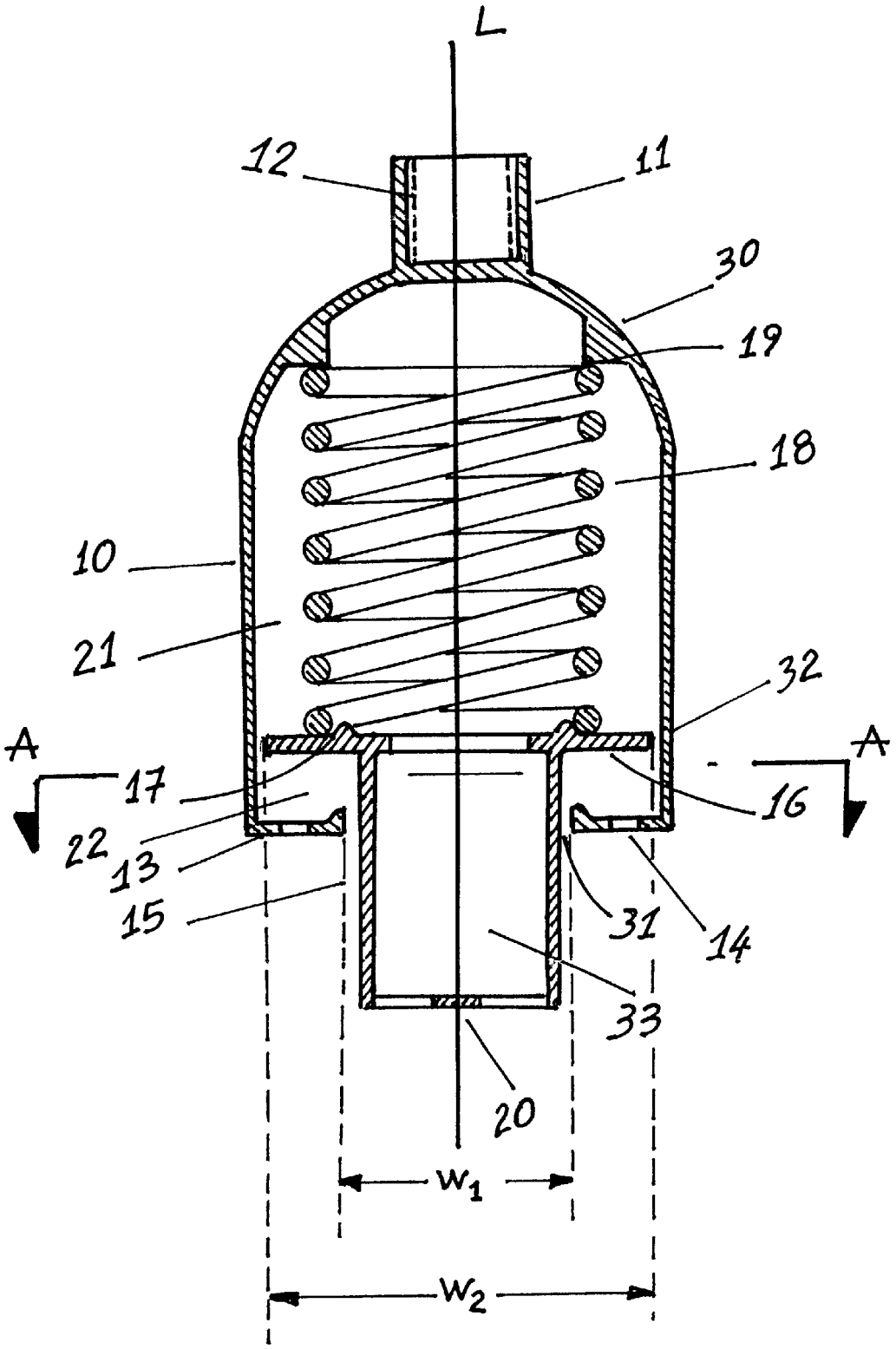
FIG. 2 is a cross-section taken along the longitudinal axis of the device depicted in FIG. 1, illustrating the internal structure of the device.
Figure 3:
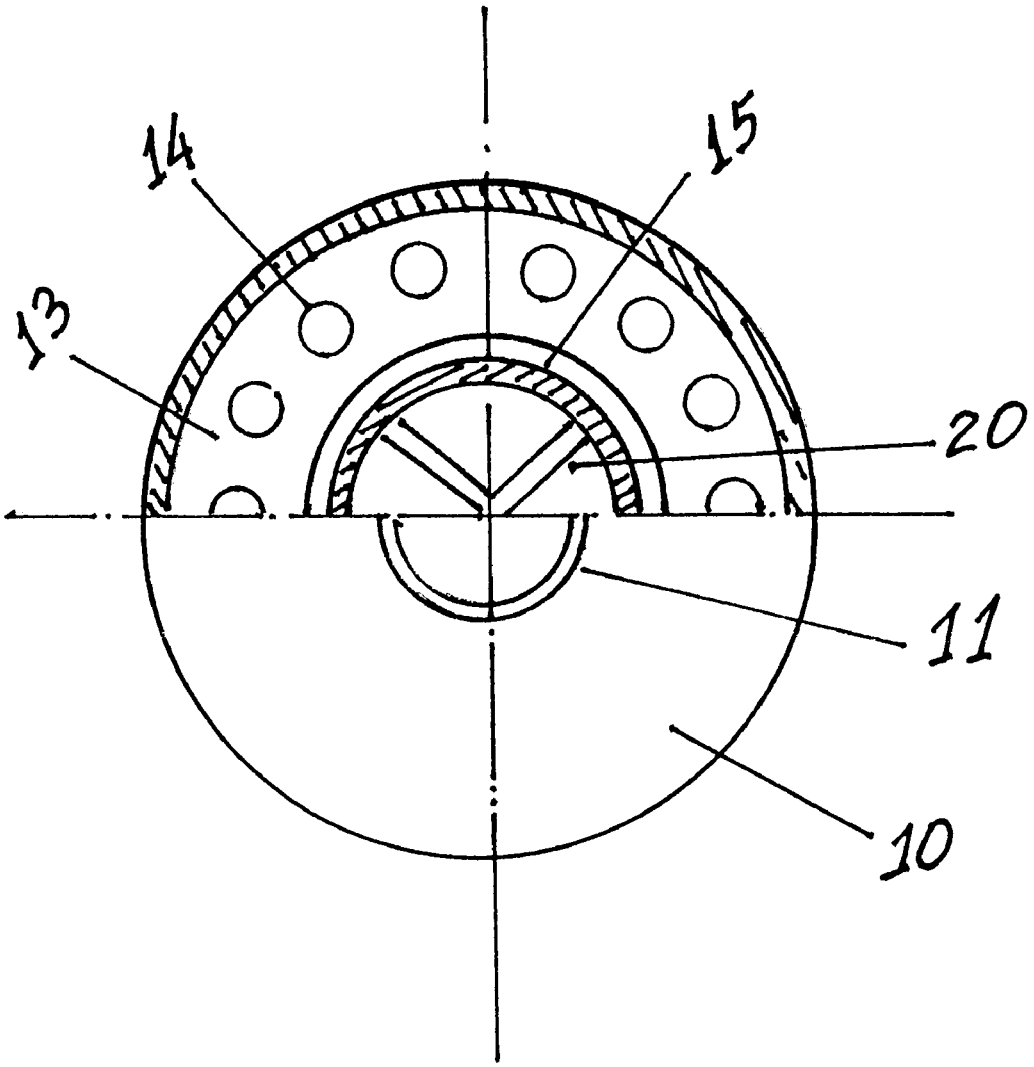
FIG. 3 shows a top plan view in the bottom portion of the figure and a partial transverse cross-sectional view through line A—A of FIG. 2 in the upper portion of the figure.

Referring to FIGS. 1–3, at its lower end, first body 10 includes a shoulder structure 13, which has a generally annular shape and is structurally cantilevered inwardly from the outer wall 32 of the first body 10. The shoulder structure 13 extends inwardly toward the interior of the device and defines opening 31 along its inner edge. Shoulder structure 13 includes a plurality of orifices 14 that are distributed around the shoulder structure 13 in a substantially circular pattern. Orifices 14 are preferably spaced from one another in a regular pattern, although this is not critical to the invention.

Inner housing or second body 15 is preferably a generally cylindrical configuration and serves as a closure member that is slidable with respect to first body 10. Second body 15 is partially positioned inside first body 10 and the lower end of second body 15 extends through opening 31. A substantially cylindrical passageway 33 extends longitudinally through second body 15. A cross-shaped brace 20 may be provided at the open bottom end of second body 15. Other shaped braces may also be provided.

As shown in FIG. 2, at its upper end, inner body 15 includes a flange, blade, or similar projection 16, which is maintained at a slight distance from the internal wall of the first body 10. Flange 16 extends outwardly from the upper end of the second body 15. As shown in FIG. 2, flange 16 may also extend inwardly to partially cover passageway 33. As shown, flange 16 is substantially annular is shape, although this is not critical to the invention.

Flange 16 may include a ridge, or similar projection of circumferential extent, 17, which it utilized to hold, retain, or restrict an internal spring 18 within the interior of the device. At its lower end, spring 18 rests against the surface of flange 16 on second body 15. At it upper end, spring 18 contacts the roof portion 30. An annular surface 19 may be provided along the interior of the domed part of the body 10 for contacting spring 18.

As seen in the cross-sectional view of FIG. 2, the washing device has a longitudinal axis L, and the first body 10 and second body 15 move relative to one another along this longitudinal axis. Within first body 10, the flange 16 has a lateral dimension $W_2$ that is transverse to the longitudinal axis A while opening 31 has a lateral dimension $W_1$ that is transverse to the longitudinal axis A, wherein $W_2>W_1$.

The washing device can be operated completely manually, with manual action being provided by the user, and a water and air source being provided by a load of wash or by input of water and/or air to the interior of the outer housing, such as through another opening, not shown. In operation, the washing device is submerged in a container which contains the clothing to be washed, along with water and detergent. The washing device is supported at its lower level by the cross-shaped brace 20, which abuts the mass of clothing. Thrust may be applied by manual manipulation of the device, by sliding the first body relative to the second body, and vice versa. In this manner, water and air from the washing tub or other source is suctioned up through passageway 33 and expelled through orifices 14. The jets of liquid and air impact the clothing and, in conjunction with the detergent, they perform the work of washing.

Alternatively, in a partially manual mode, a thrust source may be connected to projection 11 on the upper surface of outer housing 10. Thrust may be applied by the thrust source to move the outer housing upwardly and downwardly against the force of spring 18 to cause the suctioning and expelling of water against the mass of clothing in the wash tub. The thrust source may be a thrust rod, a compressed air source, or other thrust source.

The advantageous use of the washing device under relatively non-strenuous manual manipulation involves compression and decompression mediated by the interior spring, which changes the volumes of the chambers (21, 22) and is communicated through the chambers (21, 22). As a result, the pressurized jets of air and water exit through the orifices 14 of the shoulder member 13 on the body (housing) 10.

The device may be fabricated of a plastic material, or may be combined with ferrous and/or nonferrous metal for certain of its parts. Although the type of material is not critical to the invention. The practical dimensions of the device vary based upon the application. In one embodiment, the device is about 245 mm long×150 mm in diameter. In another embodiment, the device is about 257 mm long×162 mm in diameter, the diameter being that of the circular perimeter of housing 10. The dimensions of the device may vary between these dimensions, or alternatively may be greater or smaller based upon the customer's requirements, the materials used, and the size of the vessel.

While various descriptions, embodiments, and aspects of the present inventions are described above, it should be understood that the various features can be used singly or in any combination thereof. This invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A washing device having hydropneumatic action involving compression of a volume of air and water, with the air and water being expelled from the washing device under pressure, said washing device having a longitudinal axis and comprising:

an outer housing having an upper and a lower end and defining an interior, said outer housing having an upper surface substantially covering the upper end thereof and an opening in the lower end thereof, said opening having a lateral dimension $W_1$ transverse to said longitudinal axis;

an inner housing positioned at least partially in the interior of the outer housing and having a passageway extending longitudinally therethrough, with an upper end of the inner housing being positioned inside the interior of the outer housing and a lower end of the inner housing extending through the opening in the lower end of the outer housing, said inner and outer housings being slidable relative to one another along the longitudinal axis;

a flange provided on the inner housing, said flange having a lateral dimension $W_2$ transverse to said longitudinal axis, wherein $W_1<W_2$; and a spring positioned in the interior of the outer housing between the flange and the upper surface of the outer housing, the spring being substantially resilient.

2. The washing device according to claim 1, wherein the outer housing is substantially cylindrical and the upper surface of the outer housing is dome shaped, and the inner housing is substantially cylindrical and the passageway through the inner housing is substantially cylindrical.

3. The washing device of claim 2, wherein the dome shaped upper surface of the outer housing is generally convex.

4. A washing device having hydropneumatic action involving compression of a volume of air and water, with the air and water being expelled from the washing device under pressure, said washing device comprising:

an outer housing having an upper and a lower end and defining an interior, said outer housing having an upper surface substantially covering the upper end thereof and an opening in the lower end thereof;

an inner housing positioned at least partially in the interior of the outer housing and having a passageway extending longitudinally therethrough, with an upper end of the inner housing being positioned inside the interior of the outer housing and a lower end of the inner housing extending through the opening in the lower end of the outer housing, said inner and outer housings being slidable relative to one another;

a spring positioned in the interior of the outer housing between the upper end of the inner housing and the upper surface of the outer housing, the spring being substantially resilient;

wherein the outer housing includes a shoulder positioned at the lower end thereof, said shoulder extending inwardly from an outer wall of the outer housing and defining, at an inner edge of the shoulder, the opening in the lower end of the outer housing, said shoulder providing sliding contact against the inner housing.

5. The washing device according to claim 4, wherein the inner housing includes a projecting flange portion positioned at the upper end thereof, with the flange portion being positioned in the interior of the outer housing for sliding contact with an interior wall of the outer housing.

6. The washing device according to claim 5, wherein an upper surface of the flange portion includes a projection for association with the spring.

7. The washing device according to claim 6, wherein the projection is a ridge and the spring is retained by the ridge.

8. The washing device according to claim 7, wherein the upper surface of the outer housing includes a downward projection for association with an upper end of the spring, wherein the upper end of the spring is retained against the projection.

9. The washing device according to claim 4, wherein the shoulder includes a plurality of orifices distributed therealong, wherein jets of liquid and compressed air in the interior of the outer housing are expelled through the orifices under pressure.

10. The washing device according to claim 9, wherein the shoulder is annular and the orifices are circular and spaced around the shoulder in a generally regular pattern.

11. The washing device according to claim 10, wherein the shoulder further includes a lip at an inner edge thereof, said lip being positioned adjacent the inner edge of the shoulder at the opening of the outer housing.

12. The washing device according to claim 1, wherein the upper surface of the outer housing includes a projection that is internally threaded and generally cylindrical.

13. The washing device according to claim 1, wherein the inner housing further comprises a bracing portion positioned at the lower end of the inner housing within the passageway thereof.

14. The washing device according to claim 1, further comprising a projection extending from upper surface of the outer housing, and a thrust source attached to the projection on the upper surface for applying thrust to the outer housing.

15. The washing device according to claim 14, wherein the thrust source is compressed air.

16. The method for performing washing comprising:

providing an outer housing with an upper surface substantially covering the upper end thereof, an opening provided at the lower end thereof and having a lateral dimension $W_1$ transverse to a longitudinal axis of said outer housing, and an interior;

providing an inner housing having an upper end and a lower end, with a passageway extending through the interior thereof from the upper end to the lower end, said upper end of said inner housing being positioned inside the interior of the outer housing, and the lower end of the inner housing extending outside the outer housing through the opening in the lower end of the outer housing;

providing a flange on the inner housing, said flange having a lateral dimension $W_2$ transverse to said longitudinal axis, wherein $W_1>W_2$; and providing a spring in the interior of the outer housing, said spring being positioned between the flange and the upper surface of the outer housing, wherein said spring is resilient;

providing a plurality of orifices along the lower end of the outer housing to allow fluid to exit the interior of the outer housing;

positioning the lower end of the inner housing in a source of water and air; and sliding the outer housing relative to the inner housing against a force of the spring to suction up air and water from the source of water and air and expel a jet of water and air through the orifices provided along the lower end of the outer housing to perform washing.

17. The method according to claim 16, further comprising:

providing a projection extending from an upper surface of the outer housing;

attaching a thrust source to the projection extending from the upper surface; and applying a thrust to the outer housing via the thrust source.

* * * * *